US006223717B1

(12) United States Patent
Wiemers

(10) Patent No.: US 6,223,717 B1
(45) Date of Patent: May 1, 2001

(54) OPERATION OF A GASOLINE DIRECT-INJECTION INTERNAL COMBUSTION ENGINE OF A MOTOR VEHICLE HAVING A SERVO UNIT

(75) Inventor: Oliver Wiemers, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/514,318

(22) Filed: Feb. 28, 2000

(30) Foreign Application Priority Data

Feb. 26, 1999 (DE) ..... 199 08 408

(51) Int. Cl.[7] ..... F02B 17/00
(52) U.S. Cl. ..... 123/295; 123/333
(58) Field of Search ..... 123/305, 295, 123/333, 399; 477/206

(56) References Cited

U.S. PATENT DOCUMENTS 5,070,832 * 12/1991 Hapka et al. ..... 123/333
5,730,103 * 3/1998 Takizawa et al. ..... 123/333
5,945,044 * 11/1999 Kamura et al. ..... 123/295
6,050,232 * 4/2000 Grob et al. ..... 123/295
6,062,191 * 5/2000 Ooba ..... 123/295
6,092,507 * 7/2000 Bauer et al. ..... 123/295
6,116,210 * 9/2000 Oder et al. ..... 123/305

* cited by examiner

*Primary Examiner*—John Kwon
(74) *Attorney, Agent, or Firm*—Walter Ottesen

(57) ABSTRACT

The invention is directed to a method and a control apparatus for operating an internal combustion engine especially of a motor vehicle. The engine has a combustion chamber (3) into which fuel is directly injected and is combusted in a homogeneous mode of operation or in a stratified-charge mode of operation. The engine includes an underpressure store (6) connected to an intake manifold (1). The underpressure store (6) makes available the auxiliary energy which is required for the servo units (8, 10, 11) of the motor vehicle. In the method and control apparatus, a throttle (19), which is provided in the intake manifold (1), is so adjusted during stratified-charge operation of the engine that the pressure in the intake manifold (1) is reduced in the event that a suppressed injection is present especially because of overrun fuel cutoff or a charge of pressure to the underpressure source (6) because of at least one servo unit (8, 10, 11) whereby the underpressure in the underpressure store is reduced.

13 Claims, 2 Drawing Sheets

OPERATION OF A GASOLINE DIRECT-INJECTION INTERNAL COMBUSTION ENGINE OF A MOTOR VEHICLE HAVING A SERVO UNIT

FIELD OF THE INVENTION

The invention relates to a method for operating an internal combustion engine especially for a motor vehicle. The engine has a combustion chamber into which fuel is directly injected. Furthermore, the invention relates to a control apparatus for such an internal combustion engine.

BACKGROUND OF THE INVENTION

In motor vehicles, it is known that the servo brake system and the servo steering system mostly draw their auxiliary energy from an underpressure store which is connected to an intake manifold. The intake manifold serves to supply the engine with the air (that is, the necessary oxygen) for the combustion. Here, the intake manifold underpressure is stored in the underpressure store which is connected via a check valve to the intake manifold. For an adequate boosting of the braking force, there must have, in each case, an underpressure been present for an adequately long time in the intake manifold in order to ensure the corresponding underpressure in the underpressure store. When there is low pressure in the intake manifold, air flows from the store into the intake manifold. The pressure in the underpressure store then drops to the pressure in the intake manifold. When the brake is actuated, the underpressure store is connected via a valve to a control element which boosts the braking force. Air then flows into the underpressure store and thereby increases the store pressure.

In internal combustion engines of the above type, a throttle flap is provided in the intake manifold with which the air supplied to the combustion chamber can be adjusted. In conventional internal combustion engines and especially in the spark-ignition engine, the throttle flap closes when the driver takes the foot off the accelerator pedal during braking whereby the store underpressure is generated and maintained. For these internal combustion engines, it is especially ensured that the underpressure store can provide the underpressure, which is required for the servo brakes, even during longer braking operations.

In newer internal combustion engines equipped with gasoline direct injection (GDI), this is, however, not always ensured. For example, the throttle flap is opened so wide during a heating operation of a catalytic converter that there is no longer an adequate underpressure present in the intake manifold and therefore the underpressure required for the servo system(s) can no longer be made available also in the underpressure store.

Intake manifold underpressure for servo functions is available only to a limited extent in internal combustion engines having GDI wherein the throttle flap is controlled independently of the position of the accelerator pedal transducer. Examples for this are operating states during intake manifold injection with a retarded ignition angle for heating the catalytic converter during warmup of the engine. Here, a desired deterioration of efficiency must be compensated by opening the throttle flap. This leads to an increase of the intake manifold pressure. The known stratified-charge operation in the case of gasoline direct injection is a comparable operating state wherein the throttle flap is fully opened even at low load and therefore no intake manifold pressure is available.

However, especially in the operation of vehicles at high elevations such as during travel in mountainous country, the difference with respect to the ambient pressure is no longer sufficient for the servo functions.

The servo braking system is especially critical with respect to safety in vehicles. If no adequate underpressure is available, no braking force is available or there can be no operation of the engine in the stratified-charge mode because of safety reasons and this leads to a deterioration in the exhaust gas or consumption.

It is therefore already known to solve the problem in that the throttle flap opening is so designed that there is always sufficient underpressure. This has the consequence (for example, during heating of the catalytic converter) that the design of the throttle flap opening is not optimal with respect to exhaust gas. For GDI, an underpressure switch is, inter alia, utilized. If the pressure in the brake booster rises above a threshold value, then there is a switchover from stratified operation to homogeneous operation.

As an alternate solution, an additional underpressure pump or servo pump can be built into the vehicle in order to compensate for the difference pressure which is perhaps not present. This, however, leads to increased cost.

In motor vehicles which are equipped with GDI-operated spark injection engines, the following problem is especially presented. The underpressure for the brake booster is made available in conventional spark-ignition engines with intake manifold injection via the intake manifold underpressure. In GDI engines, this intake manifold underpressure is not available when the engine is operated in the stratified-charge mode of operation.

However, it must be ensured at all times that sufficient underpressure is available for the brake booster. It is, however, unnecessary to continuously supply the brake booster with underpressure when there is an underpressure store available; instead, it is sufficient to provide a regular "fill-up" of the underpressure store with underpressure.

In known internal combustion engines, the above-mentioned problematic is solved by the use of a pressure switch or a pressure sensor. The purpose of the switch is to transmit an appropriate signal to an engine control apparatus when the underpressure in the brake booster is too low. The engine control apparatus then requests a switchover from the stratified-charge mode of operation to the homogeneous mode of operation and the required intake manifold underpressure is thereby again made available. These internal combustion engines have the disadvantage that additional costs are incurred for the mentioned switches or sensors.

Further disadvantages of the known internal combustion engines result from the frequency with which there is a switchback to the homogeneous mode of operation when the pressure sensor responds. The fuel consumption of the engine and therefore of the vehicle deteriorates with the switchover into the homogeneous operation in an operating region of the engine in which no homogeneous operation would normally be necessary.

In a GDI engine, its consumption advantages are demonstrated mostly only in the stratified-charge mode of operation. For this reason, efforts are being made to cover as many operating regions with the stratified-charge mode of operation and to operate the internal combustion engines as long as possible in this operating mode.

The significance of GDI engines is that the engine is operated as unthrottled as possible (throttle flap open, intake manifold pressure corresponds to ambient pressure) independently of the power output or torque output. In this way, charge-cycle losses are minimized.

SUMMARY OF THE INVENTION

It is an object of the invention to provide a method for operating an internal combustion engine as well as a control apparatus corresponding thereto which avoid the above-mentioned disadvantages of the state of the art and simultaneously ensure an operation as reliable as possible of the underpressure store for making available the auxiliary energy, which is required for the servo units, at every time point and in every operating state of the engine.

The method of the invention is for operating an internal combustion engine in the context of a motor vehicle including at least one servo unit, which requires auxiliary energy in the form of an underpressure, the internal combustion engine including an intake manifold to which outside air is supplied in a controlled manner via a throttle and a combustion chamber into which air from said intake manifold is passed and into which fuel is directly injected and wherein combustion takes place in a stratified charge mode of operation or a homogeneous mode of operation. The method includes the steps of: providing an underpressure store to make the underpressure available to the servo unit and connecting the underpressure store to the intake manifold so as to ensure a pressure-conducting connection therebetween; and, adjusting the throttle during the stratified charge mode of operation so as to reduce the pressure in the intake manifold if at least one of the following operating states is present:

(a) a suppression of injection because of overrun fuel cutoff; and, (b) an application of pressure to the underpressure store caused by the servo unit.

The invention is therefore based on the concept of utilizing every possibility to make available intake manifold underpressure for a servo unit such as a brake booster without, however, having to change over unnecessarily often into the homogeneous mode of operation. In actual driving operation, there are often phases wherein the fuel injection is suppressed such as in the case of an overrun fuel cutoff (operator of vehicle lifts foot away from accelerator pedal). If the overrun fuel cutoff occurs during the operation in the stratified-charge mode of operation, then the throttle flap can be closed without moving out of the actual stratified-charge mode of operation. An overrun fuel cutoff occurs, as a rule, with the start of a braking operation; however, the advantages provided by the invention are realized also for the simultaneous actuation of the accelerator pedal and of the brake pedal in order to have the largest possible margin of safety for the braking servo unit even in this special situation.

The invention eliminates the deficiency as to intake manifold underpressure for servo units in that each opportunity is utilized in order to achieve a pressure reduction in the underpressure store without it being necessary to intervene in the operating state of the engine. The operating state "overrun fuel cutoff" is especially utilized to generate intake-manifold underpressure. In the case of an overrun fuel cutoff, the throttle flap is closed and intake manifold underpressure is generated independently of the operating state of the engine (stratified-charge mode of operation or homogeneous mode of operation).

According to the invention, it is ensured at all times that underpressure is generated at the proper time in order to always make adequate underpressure available to the safety-critical system "brake booster". This is in contrast to the state of the art where the presence of underpressure is simply sensed.

According to a feature of the invention, the brake pedal switch is applied as a command for the intake manifold underpressure in lieu of the underpressure switch provided by the state of the art. An evaluation is made as to whether underpressure for the brake booster must be generated or not in dependence upon the operating state, namely, homogeneous operation with or without overrun fuel cutoff or stratified-charge operation with or without overrun fuel cutoff.

A further advantage of the invention is that a negative change of load impact (dashpot effect) is avoided by the closing of the throttle flap after a suppression of injection has occurred. In real driving operation, overrun fuel cutoff almost always occurs with braking because the driver, as a rule, first takes the foot off the accelerator pedal and then brakes. For this reason, the frequency with which one must switch over into homogeneous operation because of deficient underpressure becomes less because of the invention.

If, however, a driving operation with a large engine torque is commanded again by the driver after a previous overrun phase, no switchover from stratified-charge operation into the homogeneous operation is required because the throttle (throttle flap) is already closed and therefore a homogeneous operation of the engine without time delay is made possible. It is here noted that a large engine torque, as a rule, can only be made available in homogeneous operation. As a further advantage, no switchover jolt can occur because of the switchover from stratified-charge operation into the homogeneous operation.

According to the invention, it is a condition precedent that the position of the throttle flap is freely selectable at overrun fuel cutoff, which is anyway satisfied for GDI engines (for example, so-called E-GAS systems). The E-GAS system pertains to a configuration wherein, for example, the connection from the accelerator pedal to the throttle flap of the engine is not mechanical but is via an electronic circuit so that the throttle flap is actuated electrically.

According to another embodiment of the invention, it can be provided in the above method that, corresponding to step (b), the throttle is only adjusted when exceeding a threshold value for the pressure increase in the underpressure store. The threshold value makes it possible to arrive at a suitable compromise between optimal operating mode for the engine and the highest possible safety for the operation of the servo unit especially of the brake booster.

According to an advantageous embodiment of the invention, it can be provided that, in correspondence to step (a), the injection which is suppressed is sensed via the position of an actuator commanding power. An accelerator pedal switch or an accelerator pedal actuator can function, for example, as an actuator. Overrun fuel cutoff can thus be determined in an advantageous manner from the position of the accelerator pedal.

A pressure charge of the underpressure store by a brake servo unit can be advantageously sensed with a brake light switch or an accelerator pedal switch. This requires no additional components and can be implemented at low cost. Furthermore, the required safety during operation of the servo units is taken into account in that the brake light or brake pedal switch is subjected in general to a continuous function control.

The object of the invention is further realized in the control apparatus of the invention in that at least one of the following is provided: means for sensing a stratified-charge operation; means for sensing a suppressed injection; means for sensing a pressure charge of the underpressure store with at least one servo unit; and, means for adjusting the throttle so that the pressure in the intake manifold is reduced.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
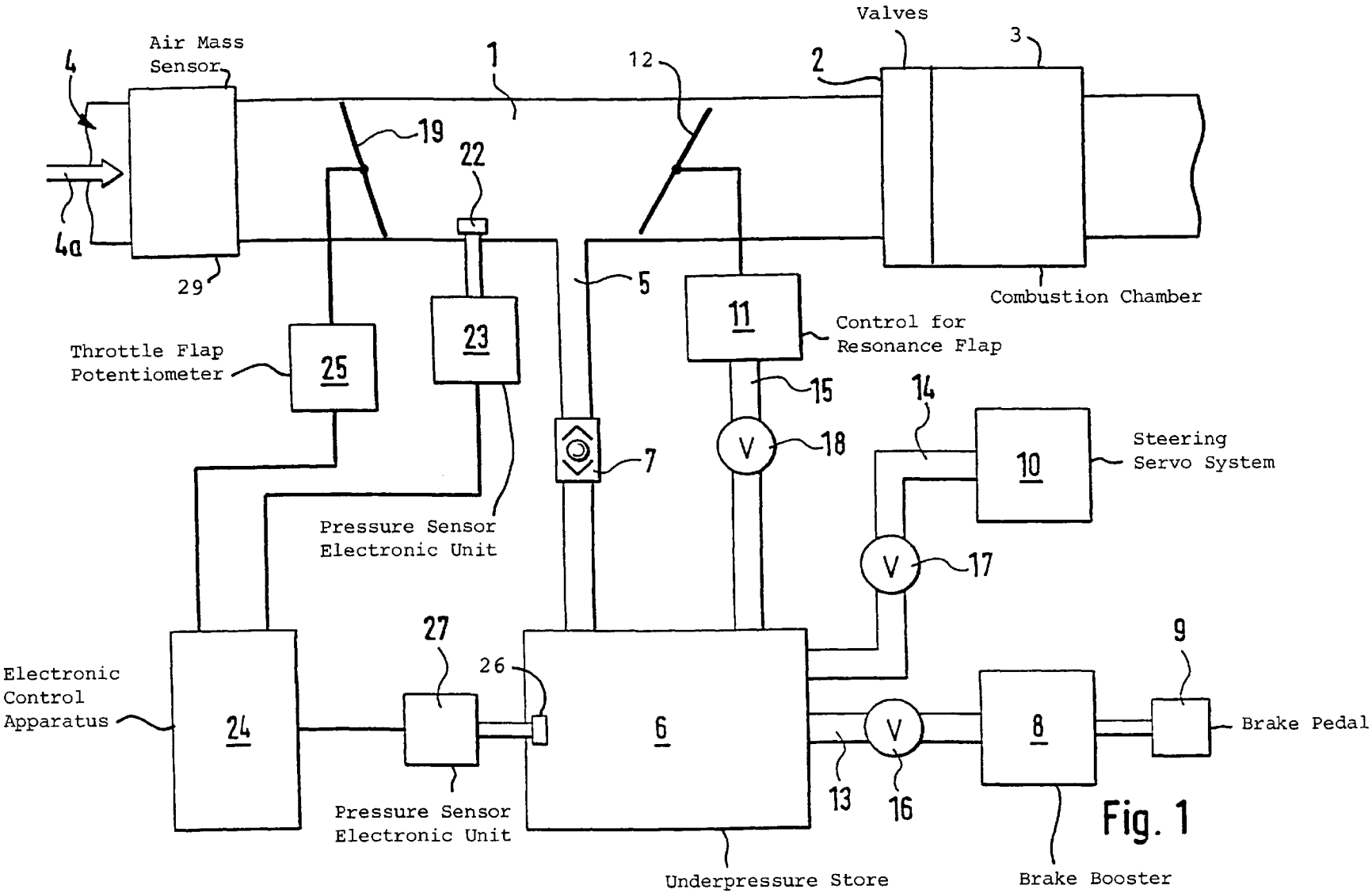
FIG. 1 is a block circuit diagram of an internal combustion engine according to the invention with the engine being for a motor vehicle; and, FIG. 2 shows an embodiment of the method of the invention in the context of a flowchart.

The internal combustion engine shown in FIG. 1 includes an intake manifold 1 which is connected via valves 2 (not shown in detail) to a combustion chamber 3 of the engine. The supply of air into the intake manifold 1 takes place via an opening 4. The intake manifold 1 is connected to an underpressure store 6 via a line 5 whereby a pressure-conducting connection is provided. A check valve 7 is mounted within this conduit.

Especially servo units of a motor vehicle are in pressure-conducting connection with the underpressure store 6. The internal combustion engine is built into the motor vehicle. In this embodiment, servo systems include a brake booster 8, which is in pressure-conducting connection with a brake pedal 9 via a primary brake cylinder (not shown), as well as a steering servo system 10 and a control 11 for a resonance flap 12. The control 11 supplies the auxiliary energy required for the operation of a resonance flap 12. These servo systems are pressure-conductively connected via lines 13, 14 and 15 to the underpressure store 6.

Valves 16, 17 and 18 are provided in the lines 13, 14 and 15, respectively. The individual servo systems are pressure-conductively connected to the underpressure store only as required by the valves 16, 17 and 18. Air flows in one of two directions in the pressure conduit 5 between the intake manifold 1 and the underpressure store 6 in dependence upon whether the pressure in the intake manifold is lower or higher than in the underpressure store 6. The check valve 7 referred to above ensures that the air flow in the direction of the underpressure store is avoided and that the underpressure store 6 is thereby not filled with air as soon as there is a higher pressure in the intake manifold 1 than in the underpressure store 6.

A throttle flap 19 is provided in the intake manifold 1 in the vicinity of the opening 4. The air flow 4*a*, which flows into the intake manifold, can be controlled by means of the throttle flap 19. Furthermore, an air mass sensor (hot-film air mass sensor) 30 and/or a pressure sensor 22 are provided in the intake manifold 1. These sensors permit the pressure present in the intake manifold to be determined. The signal supplied by the air mass sensor 29 and/or the pressure sensor 22 can first be supplied to an intake manifold pressure sensor electronic unit 23 or transmitted directly to an electronic control apparatus 24.

The position of the throttle flap 19 is determined via a throttle flap potentiometer 25 and the corresponding measurement signal is likewise supplied to the electronic control apparatus 24. As further pressure data, the pressure, which is present in the underpressure store 6 is supplied by means of a pressure sensor 26 to the control apparatus 24. This pressure data can be transmitted via pressure sensor electronic unit 27 as may be required.

Figure 2:
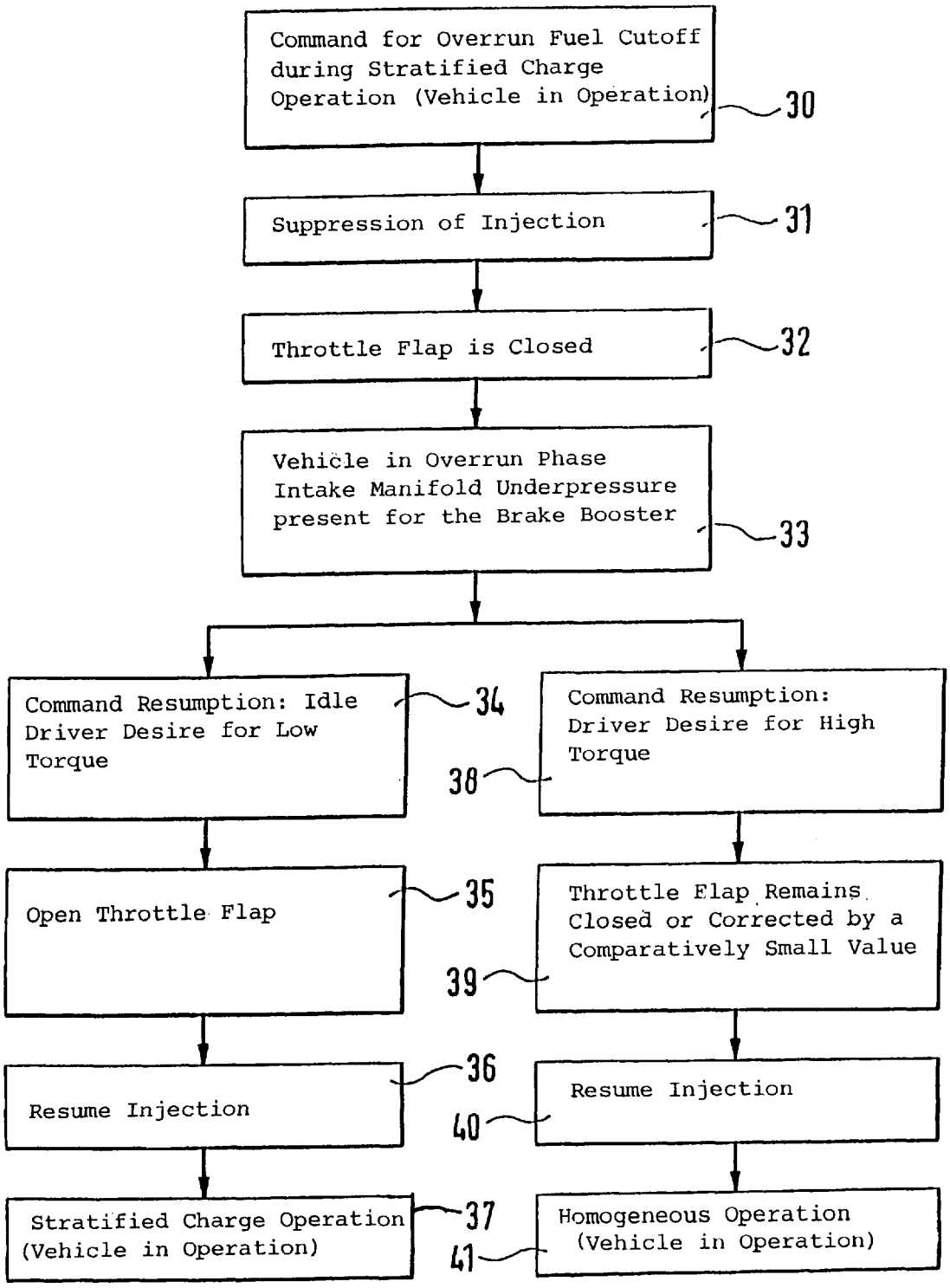

A preferred embodiment of the method of the invention will now be explained with respect to the flowchart shown in FIG. 2.

With respect to this embodiment, it is assumed that a vehicle is in driving operation and has an internal combustion engine operated in the stratified-charge mode of operation. In this connection, it is noted that the electronic control apparatus 24 is configured to control whether the engine is operating in the stratified charge mode or in the homogeneous mode. It is especially assumed that a command from the driver is present for overrun fuel cutoff (block 30), for example, by taking the foot off of the accelerator pedal. This overrun fuel cutoff (block 31) causes a direct suppression of the gasoline injection in the GDI engine which forms the basis here. In accordance with the invention, the throttle flap is closed (block 32) in order to effect a pressure reduction in the intake manifold and therefore also a corresponding pressure reduction in the underpressure store provided for the operation of the servo units of the vehicle.

A situation now occurs wherein the vehicle is in an overrun phase (block 33) and, accordingly, adequate intake manifold underpressure is present for the servo units, especially the brake booster of the vehicle. In the case of a driving operation command from the driver having a relatively low torque (block 34), for example, a strictly engine idle, the throttle flap can again be opened (block 35) and the injection for the stratified-charge operation (block 37) can again be resumed.

In the case of a subsequent command for thrust with high torque (block 38), the throttle flap however remains closed, that is, the throttle flap is corrected only by a comparatively small value in order to ensure an adequate underpressure in the intake manifold and therefore also in the underpressure store. The injection is resumed (block 40) and the engine is now operated in the homogeneous mode of operation because of the thrust command from the driver.

It should be noted that only the operating state "stratified-charge operation without overrun fuel cutoff" would make it necessary that a switchover takes place into homogeneous operation. A condition precedent here is that the throttle flap is closed in the operating state "stratified-charge operation with overrun fuel cutoff". The brake pedal switch already belongs to standard equipment for the systems or engines discussed here. For this reason, the switch for the brake underpressure can be omitted.

Of special significance is the realization of the method of the invention in the form of a control element which is provided for a control apparatus of an internal combustion engine especially of a motor vehicle. A program is stored on the control element which is suitable to run on a control apparatus, especially a microprocessor, and is suitable for carrying out the method of the invention. In this case, the invention is realized by a program stored on the control element so that this control element provided with the program defines the invention in the same way as the method for whose execution the program is suitable. An electric storage medium can be utilized as the control element, for example, a Read-Only-Memory.

It is understood that the foregoing description is that of the preferred embodiments of the invention and that various changes and modifications may be made thereto without departing from the spirit and scope of the invention as defined in the appended claims.

What is claimed is:

1. A method of operating an internal combustion engine in the context of a motor vehicle including at least one servo unit, which requires auxiliary energy in the form of an underpressure, the internal combustion engine including an intake manifold to which outside air is supplied in a controlled manner via a throttle and a combustion chamber into which air from said intake manifold is passed and into which fuel is directly injected and wherein combustion takes place in a stratified charge mode of operation or a homogeneous mode of operation, the method comprising the steps of:

providing an underpressure store to make said underpressure available to said servo unit and connecting said underpressure store to said intake manifold so as to ensure a pressure-conducting connection therebetween; and, adjusting said throttle during said stratified charge mode of operation so as to reduce the pressure in said intake manifold if at least one of the following operating states is present:

(a) a suppression of injection because of overrun fuel cutoff; and, (b) an application of pressure to said underpressure store caused by said servo unit.

2. The method of claim 1, wherein said method comprises the further step of adjusting said throttle for decreasing the underpressure in said pressure store only when a threshold value for the underpressure is exceeded in response to said operating state (b).

3. The method of claim 1, wherein the suppression of the injection for said operating state (a) is sensed via the position of an actuator demanding power.

4. The method of claim 1, wherein said servo unit is a brake booster; and, wherein the method further comprises the step of sensing the reduction of underpressure in said underpressure store with one of the following: a brake light switch and a brake pedal switch.

5. A control element for a control apparatus of an internal combustion engine of a motor vehicle on which a program is stored which can be run on a computer device and is suitable for carrying out a method of operating an internal combustion engine in the context of a motor vehicle including at least one servo unit, which requires auxiliary energy in the form of an underpressure, the internal combustion engine including an intake manifold to which outside air is supplied in a controlled manner via a throttle and a combustion chamber into which air from said intake manifold is passed and into which fuel is directly injected and wherein combustion takes place in a stratified charge mode of operation or a homogeneous mode of operation, the apparatus comprising:

providing an underpressure store to make said underpressure available to said servo unit and connecting said underpressure store to said intake manifold so as to ensure a pressure-conducting connection therebetween; and, adjusting said throttle during said stratified charge mode of operation so as to reduce the pressure in said intake manifold if at least one of the following operating states is present:

(a) a suppression of injection because of overrun fuel cutoff; and, (b) an application of pressure to said underpressure store caused by said servo unit.

6. The control element of claim 5, wherein said method comprises the further step of adjusting said throttle for decreasing the underpressure in said pressure store only when a threshold value for the underpressure is exceeded in response to said operating state (b).

7. The control element of claim 5, wherein the suppression of the injection for said operating state (a) is sensed via the position of an actuator demanding power.

8. The control element of claim 5, wherein said servo unit is a brake booster; and, wherein the method further comprises the step of sensing the reduction of underpressure in said underpressure store with one of the following: a brake light switch and a brake pedal switch.

9. The control element of claim 5, wherein said control element is a read-only-memory for said control apparatus.

10. A control apparatus for an internal combustion engine in the context of a motor vehicle including at least one servo unit, which requires auxiliary energy in the form of an underpressure, the internal combustion engine including an intake manifold to which outside air is supplied in a controlled manner via a throttle and a combustion chamber into which air from said intake manifold is passed and into which fuel is directly injected and wherein combustion takes place in a stratified charge mode of operation or a homogeneous mode of operation, the apparatus comprising:

an underpressure store for making said underpressure available to said servo unit and said underpressure store being connected to said intake manifold so as to ensure a pressure-conducting connection therebetween;

said control apparatus functioning to control whether said engine is operating in said stratified charge mode or in said homogeneous mode;

means for sensing at least one of the following:

(a) the suppression of injection of fuel to said engine; and, (b) an application of pressure to said underpressure store caused by said servo unit; and, means for adjusting said throttle so as to increase the underpressure in said intake manifold.

11. The control apparatus of claim 10, further comprising means for sensing a suppression of injection from the position of an actuator demanding power.

12. The control apparatus of claim 10, wherein said servo unit is a brake booster; and, wherein the method further comprises the step of sensing the reduction of underpressure in said underpressure store with one of the following: a brake light switch and a brake pedal switch.

13. An internal combustion engine for a motor vehicle including at least one servo unit, which requires auxiliary energy in the form of an underpressure, the internal combustion engine comprising:

an intake manifold to which outside air is supplied in a controlled manner via a throttle;

a combustion chamber into which air from said intake manifold passes and into which fuel is directly injected and wherein combustion takes place in a stratified charge mode of operation or a homogeneous mode of operation;

an underpressure store for making said underpressure available to said servo unit and said underpressure store being connected to said intake manifold so as to ensure a pressure-conducting connection therebetween;

a control apparatus functioning to control whether said engine is operating in said stratified charge mode or in said homogeneous mode;

means for sensing at least one of the following operating states:

(a) the suppression of injection of fuel to said engine because of overrun fuel cutoff; and, (b) an application of pressure to said underpressure store caused by said servo unit; and, means for adjusting said throttle during said stratified mode of operation so as to increase the underpressure in said intake manifold in response to either one of said operating states.

* * * * *